US006208074B1

(12) United States Patent
Ilegems et al.

(10) Patent No.: US 6,208,074 B1
(45) Date of Patent: Mar. 27, 2001

(54) DOUBLE-SIDED ELECTROLUMINESCENT DEVICE

(75) Inventors: Marc Ilegems, Préverenges; Michel Schär, Grandson; Libero Zuppiroli, Lausanne, all of (CH)

(73) Assignee: DPR-Ecublens, Lausanne (CH)

( * ) Notice: Subject to any disclaimer, the term of this patent is extended or adjusted under 35 U.S.C. 154(b) by 0 days.

(21) Appl. No.: 09/155,579

(22) PCT Filed: Apr. 2, 1997

(86) PCT No.: PCT/CH97/00133

§ 371 Date: Oct. 6, 1998

§ 102(e) Date: Oct. 6, 1998

(87) PCT Pub. No.: WO97/38558

PCT Pub. Date: Oct. 16, 1997

(30) Foreign Application Priority Data

Apr. 3, 1996 (CH) ..... 0863/96

(51) Int. Cl.[7] ..... H01J 1/62

(52) U.S. Cl. ..... 313/504; 313/506; 313/503; 428/690; 257/10

(58) Field of Search ..... 313/503, 504, 313/506, 501, 499, 505; 257/79, 94, 10; 428/917, 690

(56) References Cited

U.S. PATENT DOCUMENTS 5,200,668 * 4/1993 Ohashi et al. ..... 313/499
5,608,287 * 3/1997 Hung et al. ..... 313/503

FOREIGN PATENT DOCUMENTS

WO 90/13148 11/1990 (WO) ..... H01L/33/00

* cited by examiner

*Primary Examiner*—Nimeshkumar D. Patel
*Assistant Examiner*—Joseph Williams
(74) *Attorney, Agent, or Firm*—Clifford W. Browning; Woodard, Emhardt, Naughton, Moriarty & McNett

(57) ABSTRACT

An electroluminescent device including a layer of electroluminescent organic semiconductor material between a first transparent electrode of an n-type semiconductor material selected from nitrides and inorganic oxides, and a second electrode.

3 Claims, 5 Drawing Sheets

DOUBLE-SIDED ELECTROLUMINESCENT DEVICE

The present invention relates to an electroluminescent device comprising a layer of electroluminescent semiconductive organic material arranged between a first electrode, constituted by a material having the property of injecting electrons into the said layer of electroluminescent material, and a second electrode constituted by a material having the property of injecting holes into this layer.

BACKGROUND OF THE INVENTION

Devices of this kind are already known, in which the semiconductive organic material consists either of a monomer organic substance, constituted by fluorescent molecules, such as anthracene, perylene, and coronene, or by molecules of an organic dye, or of a conjugated organic polymer such as poly-(p-phenylene-vinylene).

In these devices, the electrode which emits electrons is, for example, constituted by a layer of a metal chosen from among aluminium, magnesium, and calcium, or by a layer of metallic alloy, such as an alloy of magnesium and silver, and the electrode which emits holes is constituted, for example, by a layer of a metal such as gold or by a layer of tin oxide ($SnO_2$) or mixed indium and tin oxide (ITO).

Such a device is described in the international patent application published under number WO 90/13148.

Such electroluminescent devices can be used in particular as light-emitting diodes in display elements, as well as for the manufacture of flat screens for portable computers or television sets.

These devices feature the advantage of easily allowing for the manufacture of large display surfaces, as well as allowing for an adjustment of the emitted light wavelength, therefore the emission colour, by selecting in an appropriate manner the semiconductive organic material which constitutes the electroluminescent layer from among the large number of known materials, which are suitable for this purpose, as well as the multiple combinations or modifications of these materials which are available to specialists.

In addition to this, these devices, in general, have a light emission efficiency which is quite acceptable, within the current state of the art, and which seems to be susceptible to improvements in the future within the capability of persons skilled in the art.

According to the prior state of the art relating to devices of this kind, the hole-injecting electrode has been provided in the form of a transparent layer, constituted, for example, by a mixed indium and tin oxide, the electron-injecting electrode itself being opaque or reflective. Devices of this type can emit light on only one face. According to one of the variants of the device described in application WO 90/13148, it is however mentioned that at least one of the charge-injecting contact layers, if these layers are of gold or aluminium and do not exceed a certain thickness, is transparent or semitransparent. It is not however specified which of these layers is transparent or semitransparent.

In addition to this, the devices currently known feature the disadvantage that they have a too short lifetime in regard of the envisaged industrial applications. More specifically, the best known devices of this type, in which the electroluminescent organic material layer is constituted by a monomer organic substance, only allow for a maximum period of use of the order of a thousand hours, in continuous operation, while the best known devices, in which the electroluminescent organic material layer consists of a conjugated polymer, do not in general resist a period of continuous operation greater than about a hundred hours.

SUMMARY OF THE INVENTION

The aim of the invention is to provide a device of the above-mentioned kind which is capable of emitting light on both its faces, i.e. an electroluminescent device in which both the electrodes located on either side of the electroluminescent material layer are transparent or translucent.

A further aim of the invention is to allow for the improvement of the device lifetime.

To this end, the device according to the invention is characterised in that the said first electrode is in the form of a transparent or translucent layer of a type n semiconductor material, chosen from among the mineral oxides and nitrides.

Favourably, the material constituting the electron-emitting electrode is chosen from among gallium nitride GaN, binary alloys of gallium nitride and indium nitride, of the general formula $Ga_xIn_{(1-x)}N$, ternary alloys of gallium nitride, indium nitride, and aluminium nitride, of the general formula $Ga_xAl_yIn_{(1-x-y)}N$, and mixtures of at least two of these compounds and alloys, where x and y each represent a number between 0 and 1, the total of x+y being at the most equal to 1, the n-conductivity characteristic of the said material resulting possibly from stoichiometric defects or from doping by at least one element chosen from among groups 4a and 6a of the periodic classification table.

As the doping element, use may be made in particular of one of the following elements: Si, Sn, S, Se, and Te.

The above-mentioned type n semiconductor material, in particular gallium nitride and its alloys, may be used in any appropriate form, in particular in monocrystalline, polycrystalline, nanocrystalline, or amorphous form, or even in the form of a superimposition of layers of this type having different compositions, therefore different values of x or y, or different type of doping.

Use may also be made, as the material constituting the electron-emitting electrode, of a material chosen from among titanium oxides $TiO_x$, whatever their oxygen stoichiometry may be and particularly in the sub-stoichiometric anatase and rutile phases $TiO_{2-y}$, as well as mixtures of at least one titanium oxide with at least one other mineral oxide, particularly the multiphase materials such as the Maneli phases or the multiphase mixtures of several oxides accompanying titanium oxide.

The electron-injecting character of such materials may possibly result from the existence of stoichiometric defects or from doping by at least one element such as, for example, H, Li, Ca, Al, Cs.

The above-mentioned titanium oxides may be used in any appropriate form, and in particular in monocrystalline, polycrystalline, nanocrystalline, or amorphous form.

As the electroluminescent semiconductive organic material constituting the electroluminescent layer, use may be made of any appropriate material, in particular those constituted by the substances already used for this purpose in accordance with the prior art, in particular, conjugated polymers, such as poly(p-phenylene-vinylene), commonly designated by the abbreviation PPV, or poly p-phenylene, PPP, or polythiophene, PT, those in which the phenyl or thiophene rings carrie one or more substitutents such as an alkyl group, an alkoxy group, a halogen, or a nitro group, as well as conjugated polymers such as poly(4,4'-diphenylenediphenylvinylene), commonly designated by the abbreviation PDPV; poly (1,4-phenylene-1-phenylinyene); poly(1,4-phenylene-diphenyvinylene); polymers of the type poly(3-alkylthiophene) or poly(3-alkylpyrrole), polymers of the type poly(2,5-dialkoxy-p-phenylenevinylene), or copolymers or mixtures of such conjugated polymers.

The use of conjugated polymers deriving from known polymers, such as those mentioned above, by grafting onto the polymer chain ends groups having the property of strengthening the adherence of the electroluminescent conjugated polymer onto the surface of the electrodes, in particular the electron-emitting electrode, and, more particularly, onto a layer of gallium nitride or titanium oxide, is particularly advantageous.

For example, use may be made of polymers deriving from poly(phenylene) of which the chain ends have one of the following formulae:

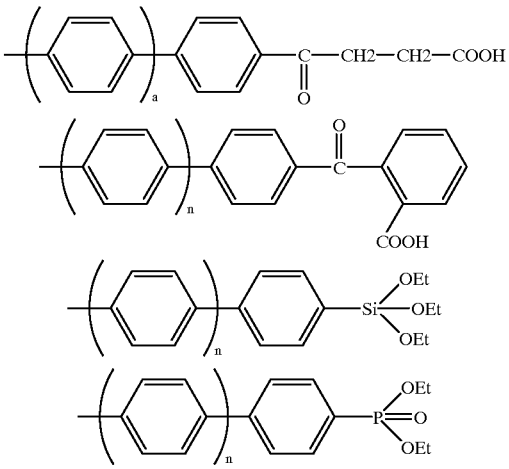

Use may equally be made, as the electroluminescent organic material constituting the electroluminescent layer, of a monomer substance, of an organic pigment or dye, this substance or this pigment or dye being possibly chosen in particular from among those appropriate for use in the electroluminescent devices of the prior art. These dyes may also be chemically modified in such a way as to adhere better to the electrode of the invention.

As the material constituting the hole-emitting electrode, use may be made of the same materials as those used in the electroluminescent devices according to the prior art, in particular gold, tin oxide $SnO_2$, or mixed indium and tin oxide (in particular the commercially available product known by the designation of ITO), in the form of a transparent layer.

It is also possible to insert, between the electron-emitting electrode and the electroluminescent semiconductive organic layer, one or more layers of material which facilitates the transport of negative charges, this material consisting, for example, of compound 8-hydroxyquinoline aluminium (usually designated by the term Alq3), as well as one or more layers of material having the property of blocking the passage of positive charges (hole-stopping layer), such a material being, for example, constituted by compound 2-(4-bi-phenyl-5-tertbutyl-phenyl)-1,3,5-oxadiazole (a compound known under the designation "Butyl-PBD").

In addition to this, it is also possible, if appropriate, to insert between the hole-emitting electrode and the electroluminescent semiconductive organic layer, one or more layers of material which facilitates the transport of positive charges. Such a material may be constituted, for example, by a compound of the type diphenyl-dimethylphenylamine, known by the designation TPD.

For the manufacture of the electroluminescent device according to the invention, use may be made of any appropriate process, in particular of the techniques used for the manufacture of devices according to the prior art.

Accordingly, in order to form the nitride layer as defined above, in particular of gallium nitride, constituting the electron-emitting electrode, use may be made of the inherently-known thermal pulverisation coating methods, in particular by means of a plasma torch, or of the coating techniques based on the liquid phase, as well as the coating processes involving chemical reactions in the vapour phase. These latter processes seem to give the best results.

More particularly, use may be made favourably, in order to form a thin gallium nitride layer, of a coating process involving a chemical reaction in the vapour phase under operational conditions identical or similar to those described by M. Ilegems in the publication Journal of Crystal Growth, 13/14, p. 360 (1972).

Preferably, the type n semiconductive mineral compound layer, constituting the electron-emitting electrode, is formed first on the surface of the substrate serving as a support to the electroluminescent device, this substrate being constituted favourably by a transparent insulating material such as a small plate of sapphire or quartz.

It is however likewise possible to form the layer of material constituting the holes-emitting electrode first on the substrate.

In order to form the titanium oxide layer as defined above, use may be made of the inherently-known titanium oxidation methods, of sol—gel polymerisation methods starting from organic precursors, of pulverisation methods with the aid of plasma or ion bombardment. These latter methods seem particularly well-indicated.

In order to form the electroluminescent semiconductive organic material layer, use may likewise be made of any appropriate technique, particularly thermal evaporation processes, immersion in a solution (the so-called "dip-coating" processes), coating of a layer of substance, such as a solution of the electroluminescent material, or of precursor agents thereof, in an appropriate solvent, onto the surface of the electron-emitting electrode (or, as applicable, of the hole-emitting electrode), by turning the substrate (the so-called "spin-coating" process) in such a way as to obtain a perfectly uniform thickness of this layer, followed possibly by a thermal or chemical treatment allowing for the formation of the film of electroluminescent material proper.

In order to form the layer of material constituting the hole-emitting electrode, such as gold, tin oxide, and mixed indium and tin oxide, it is likewise possible to proceed in an inherently-known manner, for example, by evaporation under reduced pressure or by thermal pulverisation, or evaporation under vacum by bombardment by means of electron, ion beam, etc.

Favourably, use may be made, as the substrate, of a transparent or translucent material, and the thicknesses of the layers of material constituting the two electrodes and those of possible auxiliary layers (layers for transporting or stopping negative or positive charges) are fixed in such a way that these layers are all transparent or translucent.

In this way, an electroluminescent device can be made which emits light on both its faces.

It is likewise possible, in an inherently-known manner, to form, on the external faces of the device according to the invention, one or more further auxiliary layers, such as reflective layers, forming a mirror, or such as semitransparent and/or dielectric layers, in order to direct the light emitted by the device or to enhance certain components, in particular by formation of microcavities.

It is further possible, by superimposing a plurality of devices according to the invention, for example three, each emitting light on both its faces, these devices comprising layers of different electroluminescent organic material having different light emission wavelengths, to prepare a multicoloured display device, operating by mixing colours controlled by varying voltages applied to the different layers of this device.

A second type of multicoloured display can be realised with the aid of elements formed by the juxtaposition of a plurality of devices according to the invention, for example three, these devices comprising layers of different electroluminescent organic material having different light emission wavelengths, operating by mixing colours controlled by varying voltages applied to the different devices forming each element.

A third type of multicoloured display can be prepared with the aid of elements formed by the juxtaposition of a plurality of devices according to the invention, for example three, these devices comprising further auxiliary layers favouring the selection of a narrow wavelength range within the light emission spectrum emitted by the electroluminescent organic layer(s), operating by mixing colours controlled by varying voltages applied to the different devices forming each element.

The invention may be better understood thanks to the detailed description, which follows, of non-limiting examples of the realisation of embodiments of the device according to the invention, making reference to the appended drawings.

DETAILED DESCRIPTION OF THE PREFERRED EMBODIMENTS

EXAMPLE 1

Figure 1:
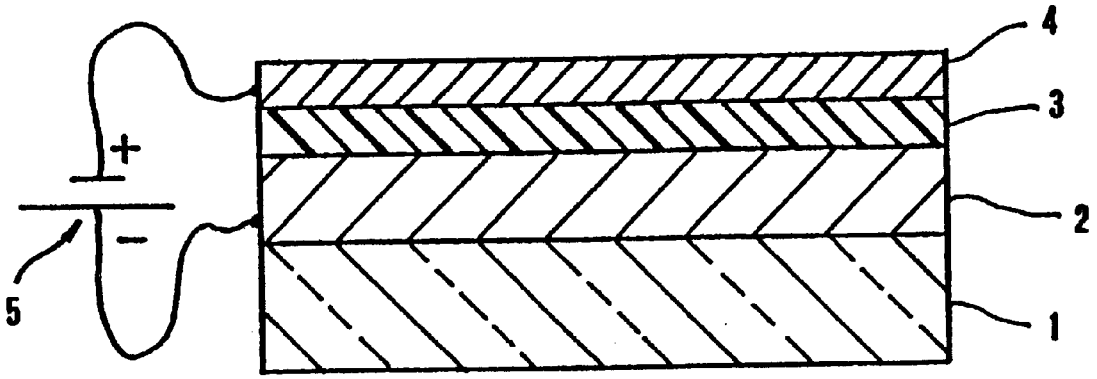
FIG. 1 is a schematic view, in section, of a first embodiment of the GaN-based device.

Manufacture of a First Embodiment of the Device According to the Invention, Such as is Illustrated in FIG. 1.

On a small square plate 1 of sapphire, with a side of 1 cm and a thickness of 0.5 mm, a thin transparent layer 2 of gallium nitride GaN, having a thickness of 10 micrometers is formed. For this purpose, gallium nitride layer 2 is coated on plate 1, serving as the substrate, by means of chemical reaction in the vapour phase between gallium chloride GaCl and ammonia $NH_3$, at a temperature of 1,050° C., in the presence of helium used as a carrier gas, the substrate being maintained at the reaction temperature by means of a susceptor heated by high-frequency induction. Heating could equally well be performed by thermal radiation and by using another carrier gas than helium, for example nitrogen.

Instead of gallium chloride, use may equally well be made of a gallium organo-metallic compound, such as trimethylgallium or triethylgallium.

The thus obtained gallium nitride layer 2 adheres strongly onto the surface of substrate 1. It features the characteristic of a type n semiconductor, resulting in stoichiometric defects, in the absence of any doping element. The surface impedance value of layer 2 is approximately 10 Ohms.

There is then formed, on the free surface of gallium nitride layer 2, a film 3 of poly[2,5-bis(cholestanoxy)-1,4-phenylenevinylene] (polymer designated by the initials BCHA-PPV) having a thickness of 0.2 micrometer. For this purpose, a drop of a solution of BCHA-PPV in xylene (concentration of this solution 10 g/liter) is dropped onto the surface of gallium nitride layer 2 and the layer of solution is distributed over this surface in such a way as to provide it with a uniform thickness, by turning plate 1 round a vertical axis, keeping the free surface of layer 2 pointing upwards in a horizontal plane, at a speed of approximately 2,000 revolutions per minute (the so-called "spin-coating" process). Plate 1, thus coated with layer 2 and BCHA-PPV solution, is then heated for one hour at a temperature of 100° C. in an oven under reduced pressure in a neutral gas (argon). This treatment induces evaporation of xylene and formation of a hard BCHA-PPV film 3 which adheres well to the free surface of gallium nitride layer 2, this film having a thickness of 0.2 micrometer.

Finally, the free surface of layer 3 is coated with a thin gold layer 4 having a thickness of 0.3 micrometer. To this end, gold layer 4 is coated by evaporation under vacum in an inherently-known manner, by using a traditional thermal evaporation device.

To form an electroluminescent device, it is sufficient to connect layers 2 and 4, which cover plate 1 and are arranged as illustrated in FIG. 1 on each side of the electroluminescent polymer film 3, to the negative terminal and to positive terminal of an electric voltage source 5.

Figure 4:
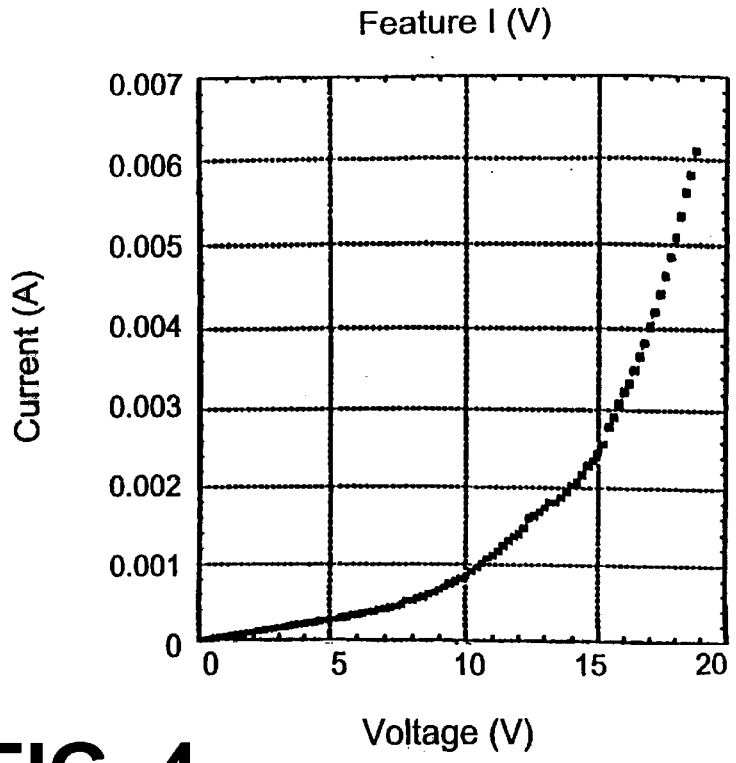
FIGS. 4 and 5 are diagrams showing respectively the characteristic current—voltage curve and the characteristic light intensity—voltage curve of the electroluminescent device illustrated in FIG. 1.
Figure 5:
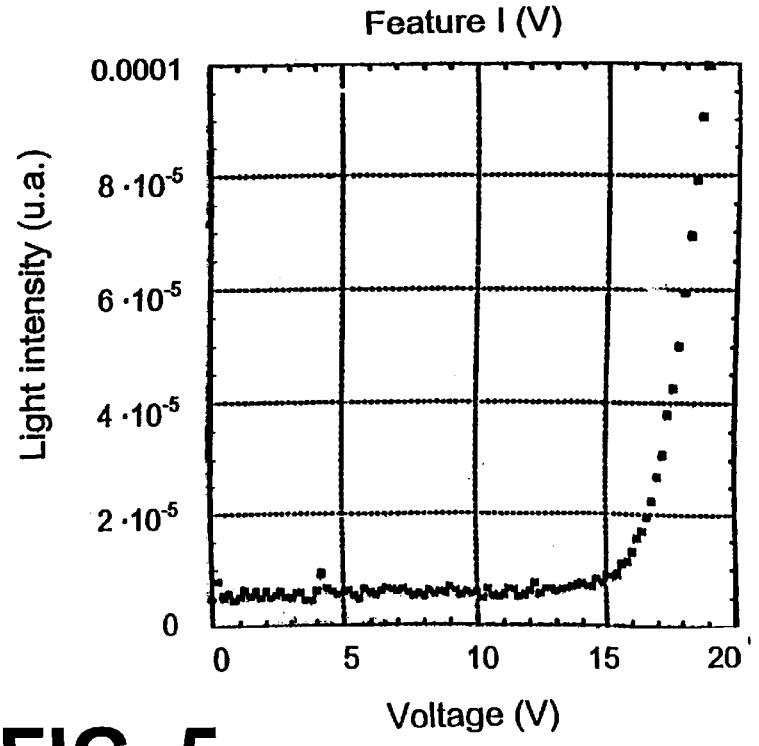

By applying an electrical potential difference of a few volts between layers 2 and 4 which thus constitute respectively the negative electrode and the positive electrode of the device, layer 2 emits electrons which are injected into polymer film 3 and layer 4 emits positive charges, designated in general by the term "holes", which are injected in the opposite direction into film 3. Charges having opposite sign which are thus injected into film 3 combine with one another and subsequently decompose, producing an emission of light, in an inherently-known manner. The characteristic current—voltage and light intensity—voltage curves of the electroluminescent device of FIG. 1 are shown respectively in FIGS. 4 and 5.

EXAMPLE 2

Figure 2:
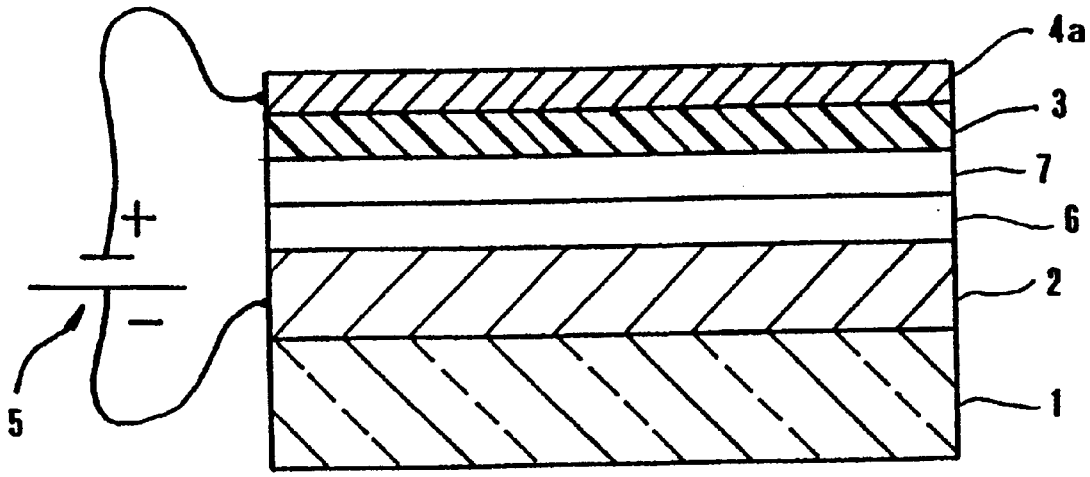
FIG. 2 is a schematic view, in section, similar to that of FIG. 1, of a second embodiment of the GaN-based device.

A Second Embodiment of the Device According to the Invention is Illustrated in FIG. 2.

This embodiment is in all respects similar to that of FIG. 1 and differs solely in that, on the one hand, a transparent layer 6 of material favouring the electron transport (this material consisting of aluminium 8-hydroxy-quinoline, a compound commonly designated by the denomination Alq3) and a transparent layer 7 of material constituting a positive charges-stopping layer (this material consisting of 2-(4-biphenyl-5-(tertbutyl-phenyl) 1,3,5-oxadiazole, a compound commonly designated by the term "butyl-PBD") are inserted between gallium nitride layer 2 and electroluminescent material layer 3 and, on the other hand, in that the holes-emitting electrode is constituted by a transparent layer 4*a* of indium and tin oxide (a commercially available product designated by the denomination ITO) having a thickness of 0.15 micrometer.

Layers 6 and 7 each have a thickness of 0.02 micrometer.

EXAMPLE 3

Figure 3:
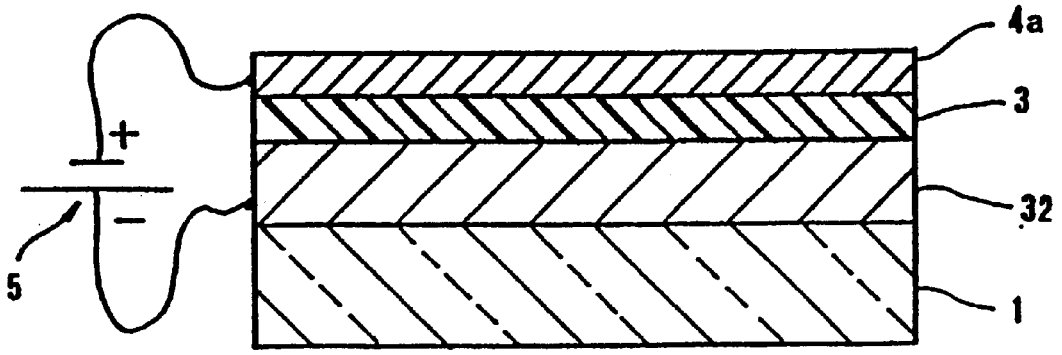
FIG. 3 is a schematic view, in section, of an embodiment of the $TiO_2$-based device.

Manufacture of a Third Embodiment of the Device According to the Invention, Such as is Illustrated in FIG. 3.

A thin, transparent layer 32 of amorphous titanium oxide $TiO_2$, strongly doped with aluminium, is formed on a small square glass plate 1 with a side of 1 cm and a thickness of 1 mm. To this end, a 10 nm thick aluminium layer is first evaporated, then a 10 nm thick $TiO_2$ layer, follows by a new 1 nm thick aluminium layer, are pulverised with the aid of a magnetron and so on until the total thickness of layer 2 is 50 nm. Once the operation has been completed and after thermal homogenisation treatment at 300° C. for one hour, under an oxygen atmosphere, it is found that aluminium has merged with titanium oxide in such a way that the final layer of merged $TiO_2$ is transparent and features an resistance of the order of 100 Ohms for an element with a square surface.

As in Example 1, a layer 3 of electroluminescent BCHA-PPV polymer is then formed by spin-coating.

Finally, a thin layer 4*a* of ITO, obtained in an inherently-known manner by pulverisation on a target of ITO by ionic bombardment, is applied on the free surface of layer 3.

Figure 6:
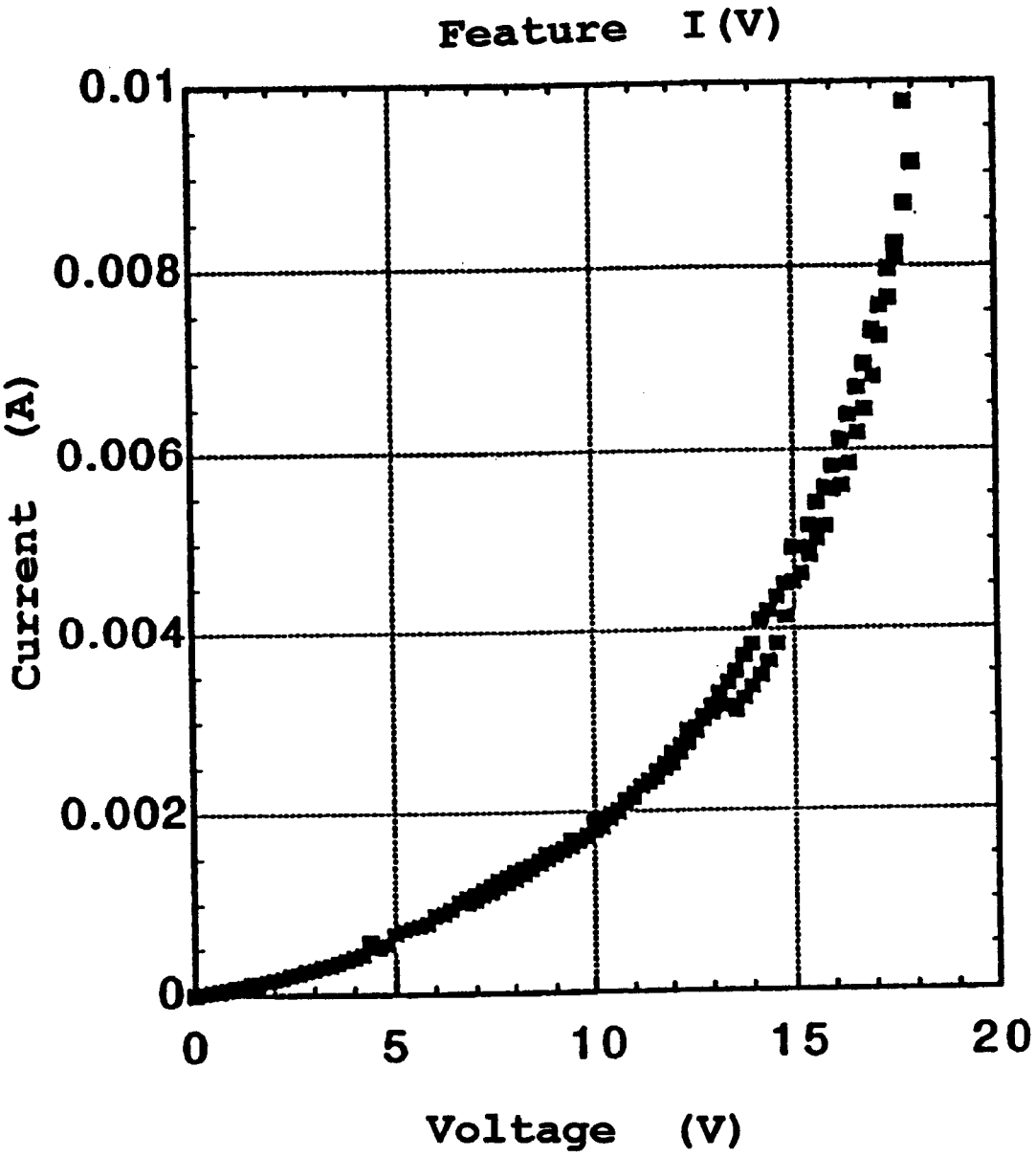
FIGS. 6 and 7 are diagrams showing respectively the characteristic current—voltage curve and the characteristic light intensity—voltage curve of the device illustrated in FIG. 3.
Figure 7:
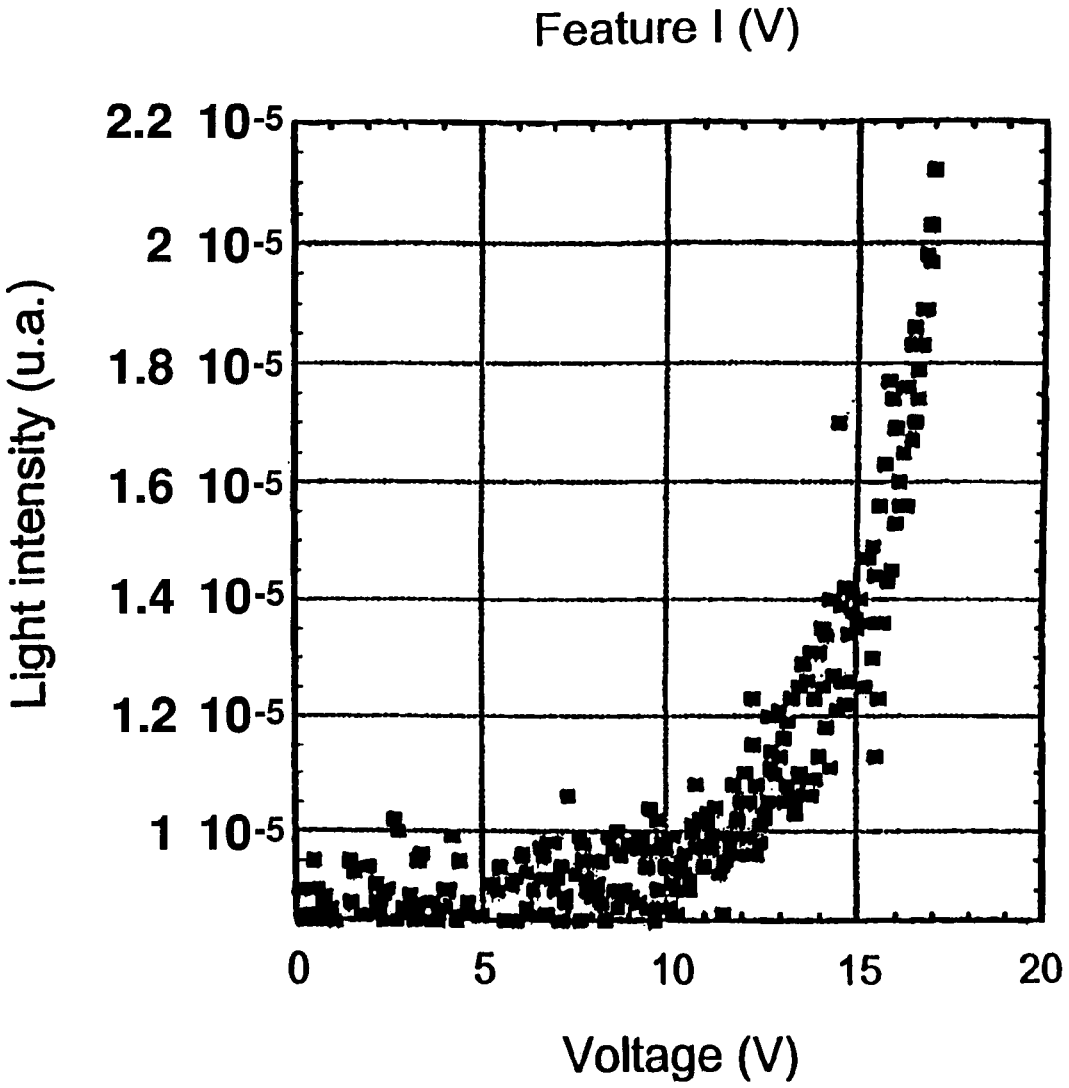

The use of this electroluminescent device is in every respect similar to that of the device of Example 1. The characteristic current—voltage and light intensity—voltage curves of the electroluminescent device illustrated in FIG. 3 are indicated respectively in FIGS. 6 and 7.

What is claimed is:

1. An electroluminescent device, comprising a layer of electroluminescent semiconductive organic material, arranged between a first electrode, constituted by a material having a property of injecting electrons into said layer of electroluminescent material, and a second electrode, constituted by a layer of electrically conductive material having the property of injecting holes into the layer of electroluminescent material, characterized in that said first electrode is in a form of a transparent or translucent layer of a type n semiconductor material chosen from among mineral nitrides.

2. A device according to claim 1, characterized in that said semiconductor material is chosen from among gallium nitride GaN, binary alloys of gallium nitride and indium nitride, of general formula $Ga_xIn_{(1-x)}N$, binary alloys of gallium nitride and aluminium nitride and ternary alloys of gallium nitride, indium nitride, and aluminium nitride, of a general formula $Ga_xAl_yIn_{(1-x-y)}N$, and mixtures of at least two of these compounds and alloys, where x and y each represent a number between 0 and 1, a total of x+y being at most equal to 1.

3. A device according to claim 2, characterized in that gallium nitride is in a sub-stoichiometric state or in a state of being doped by at least one element chosen from among groups 4a and 6a of the periodic classification table.

* * * * *

UNITED STATES PATENT AND TRADEMARK OFFICE

CERTIFICATE OF CORRECTION

PATENT NO. : 6,208,074 B1 
DATED : March 27, 2001
INVENTOR(S) : Marc Llegems, Michel Schar and Libero Zuppiroli It is certified that error appears in the above-identified patent and that said Letters Patent is hereby corrected as shown below:

Column 3,
Line 23, please change “a” to -- n --.

Column 6,
Line 20, please change “liter” to -- litre --.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,208,074 B1 
DATED : March 27, 2001
INVENTOR(S) : Marc Llegems, Michel Schar and Libero Zuppiroli It is certified that error appears in the above-identified patent and that said Letters Patent is hereby corrected as shown below:

Title page,
Item [73], Assignee, change "DPR-Ecublens" to -- Ecole Polytechnique Federale de Lausanne --.

Signed and Sealed this

Fifth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,208,074 B1
DATED : March 27, 2001
INVENTOR(S) : Marc Ilegems et al.

It is certified that error appears in the above-identified patent and that said Letters Patent is hereby corrected as shown below:

Title page,
Item [73], Assignee, change "DPR-Ecublens" to -- Ecole Polytechnique Federale de Lausanne --.

Column 3,
Line 23, please change "a" to -- n --.

Column 6,
Line 20, please change "liter" to -- litre --.

This certificate supersedes Certificates of Correction issued June 18, 2002 and November 5, 2002.

Signed and Sealed this

Eleventh Day of February, 2003

JAMES E. ROGAN
*Director of the United States Patent and Trademark Office*